United States Patent [19]

Van De Weghe

[11] 4,028,529

[45] June 7, 1977

[54] CURRENCY EXCHANGE CALCULATOR

[76] Inventor: George W. Van De Weghe, 477 Colonial Road, Ridgewood, N.J. 07450

[22] Filed: Aug. 28, 1975

[21] Appl. No.: 608,757

[52] U.S. Cl. ..... 235/89 R; 235/70 A; 235/70 C

[51] Int. Cl.[2] ..... G06G 1/02

[58] Field of Search ..... 235/70 R, 70 A, 70 B, 235/70 C, 78 R, 84, 85 R, 89 R, 89 A

[56] References Cited

UNITED STATES PATENTS

| | | | |
|---|---|---|---|
| 3,083,906 | 4/1963 | Giuntini | 235/89 R |
| 3,784,093 | 1/1974 | Bennett | 235/70 R |
| 3,795,795 | 3/1974 | Gulbransen, Jr. | 235/70 R |

*Primary Examiner*—Stanley J. Witkowski
*Attorney, Agent, or Firm*—Kenyon & Kenyon, Reilly, Carr & Chapin

[57] ABSTRACT

A hand calculator is described for converting monetary amounts from one currency to another comprising a slide with a plurality of parallelly disposed logarithmic scales thereon, a sleeve engaged with the slide and having an index means, and a cursor slidably engaged about a portion of the sleeve and having an index means thereon. For facilitating the calculation of gratuities as well as for converting currencies, the logarithmic scales are laterally oriented such that adjacent scales are displaced by a factor of 15 percent (or 0.15). In an alternative embodiment, the cursor has means for receiving a movable marker which may be used to mark a scale to which the user wishes to later refer.

7 Claims, 5 Drawing Figures

CURRENCY EXCHANGE CALCULATOR

BACKGROUND OF THE INVENTION

This invention relates generally to hand calculating devices and more particularly to slide-rule type calculating devices.

Hertofore, in settling bills in countries other than their home country, tourists and others have often been faced with the need to rapidly convert currencies from one monetary system to another, and this has frequently been a problem for persons not adept at multiplying arbitrary amounts of money by the money market scale factors which are used to convert from one monetary system to another. Besides at times being embarrassing to the tourist or other traveller, such situations have also frequently proven to be costly when mistakes have been made as to the desired monetary conversion.

To solve this problem, conversion tables have been available with tables of illustrative monetary conversions. These tables have, however, been of limited utility as they have required the user to approximate to the nearest entry in the tables the particular amount of money which the user is interested in converting. Further, different tables have had to be used for each country with a different currency or exchange rate. Also, the tables have had to be replaced where the exchange rates have fluctuated due to currency revaluations or money market conditions.

Alternatively to such conversion tables, conventional slide rules and hand electronic calculators have been available for making accurate calculations, but available hand electronic calculators have been relatively expensive and bulky for use by travellers for currency conversions, and conventional slide rules have been found to be confusing to the average person not trained in their use. For example, the ordinary slide rule does not permit a direct reading of the monetary amount to be converted but requires training in extrapolating and interpolating the members appearing on the slide rule. Also, determination of gratuities on a conventional slide rule requires the displacement of the scales on the slide rule in such a manner that the monetary conversion factor has to be recalculated or reset on the slide rule before a second conversion can be performed.

With the present invention it is only necessary to set the calculator to display a single conversion from one currency to the other, and then all other conversions become conveniently displayed in a single operation. Furthermore, with the present invention gratuities can be calculated without disturbing the setting of the calculator determined by the first conversion. Also, after the calculator is used to convert an amount of currency, an appropriate gratuity can be determined without further mechanical manipulation of the calculator.

OBJECTS OF THE INVENTION

One object of the present invention is to provide a convenient and simple device for enabling a mathematically inexperienced traveller to quickly convert an amount of money into another monetary system.

Another object of this invention is to provide a device for quickly calculating gratuities in either of two involved currencies.

Still another object of this invention is to provide an inexpensive and non-bulky currency convertor for use by a traveller.

A further object of this invention is to provide an easily used currency calculator which does not have to be readjusted prior to performing each conversion, and which is readily reset as one travels from country to country having varying conversion factors.

BRIEF DESCRIPTION OF DRAWINGS

Reference is now made to the accompanying drawings for a better understanding of the nature and objects of the invention. The drawings illustrate the best mode presently contemplated for carrying out the objects of the invention and its principles, and they are not to be construed as restrictions or limitations on its scope. In the drawings.

SUMMARY OF THE INVENTION

Figure 1:
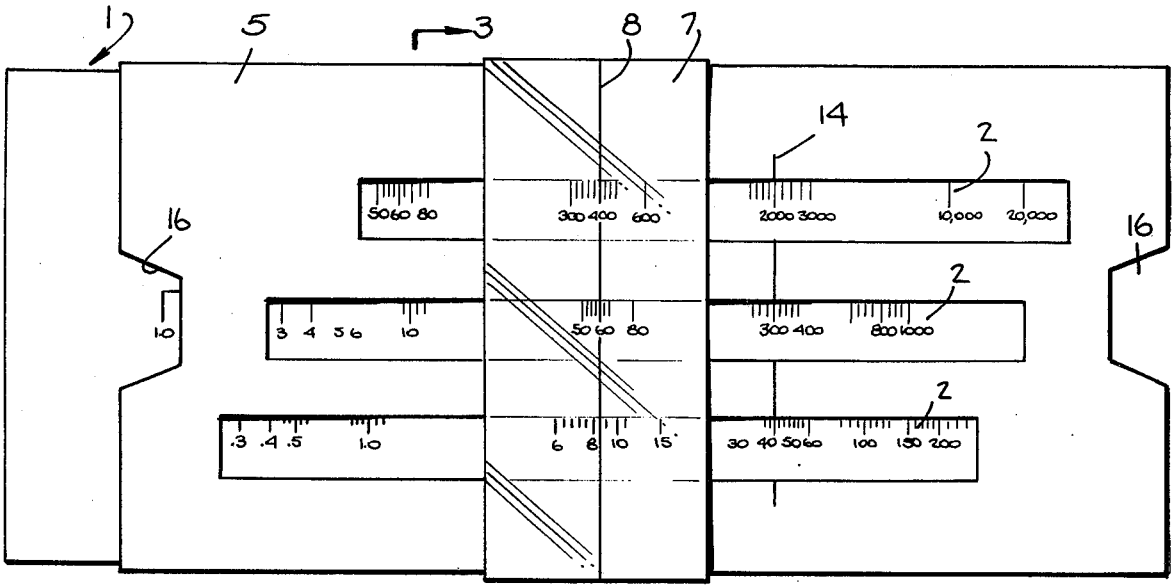
FIG. 1 illustrates a plan view of an embodiment of the currency exchange calculator of this invention comprising an assembled slide, with three logarithmic scales partly shown thereon, a sleeve and cursor.

Towards the accomplishment of the afore-mentioned objectives and those which will become apparent through a reading of the specification, a currency exchange calculator is disclosed comprising a slide, a sleeve, a cursor and in one embodiment a marker, for facilitating the conversion of monetary units from one monetary system to another and for the calculation of gratuities. In the described embodiment, the slide is preferably a two-sided paper element contained within a transparent protective envelope for enabling cleaning of the slide and increasing its stiffness or rigidity. On the slide are provided logarithmic and quasilogarithmic scales, preferably three linear scales to a side, which are parallel to one another and longitudinally staggered or displaced such that a number on a given scale is 15 percent of a vertically aligned number on an adjacent scale immediately above the given scale. The range of values on the scales is selected so as to be convenient for the conversion of typical currencies.

The sleeve of the described embodiment of the currency exchange calculator has openings or transparent sections which expose the mentioned scales of the slide when the slide is disposed within the sleeve. The sleeve also has a sleeve index means to permit the alignment and comparision of corresponding numbers on the various scales. The cursor of the currency exchange calculator is preferably of a transparent plastic material and it is adapted to slide over the sleeve. The cursor has a cursor index means thereon which permits the alignment and comparison of other numbers on the mentioned scales.

In an alternative embodiment, the cursor is formed with a slot which is adapted to receive a marker means such as a slidable button, which may be used to mark a scale to which the user wishes to later refer.

DETAILED DESCRIPTION OF THE PREFERRED EMBODIMENT

Referring now to the drawings in detail, the embodiment of the invention illustrated in FIGS. 1, 2, 3 and 4 comprises a slide 1 which is preferably made from paper and which bears a plurality of scales 2 and 22 printed thereon. The scales 2 comprise a series of ruled lines 3 marked by numbers in a linear arrangement such that the distance of each ruled line from its leftmost end (as partially seen in FIG. 1) is proportional to the logarithm of the number associated with that rule line. In the preferred embodiment three logarithmic scales 2 are provided on one face of the slide 1, and illustrative face being shown partially in FIG. 1. The scales 22 comprise a series of ruled lines 3 marked by numbers identical to those marked on the scales 2 except that for each such scale 22, all numbers greater than or equal to a predetermined number, hereinafter called the cut number for that scale, are determined by multiplying by ten the corresponding number on the corresponding scale 2. Scales that are formed in this manner are termed quasi-logarithmic. In the preferred embodiment the portion of each quasi-logarithmic scale that has marked thereon numbers greater than or equal to its associated cut number is printed in a different color from the remainder of the scale, preferably red. In the preferred embodiment three quasi-logarithmic scales are provided on a second face of the slide 1, an illustrative face being shown in FIG. 2.

Figure 2:
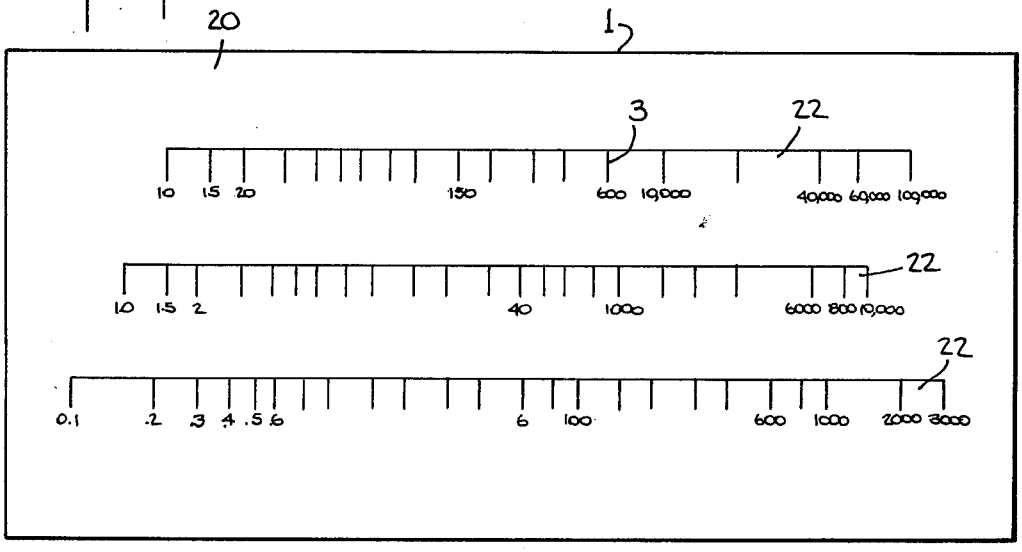
FIG. 2 illustrates a plan view of the reverse face of the slide of the calculator shown in FIG. 1 and the three linear quasi-logarithmic scales thereon.

The range of numbers for the three scales on the face of the slide 1 shown in FIG. 2 is 10 to 100,000. 1 to 10,000 and 0.1 to 3,000, with respective cut numbers 10,000, 1,000 and 100, and on the other face shown in part in FIG. 1 is 10 to 10,000, 1 to 1,000 and 0.1 to 300. These ranges will permit conversion of currencies with exchange rates up to 1,500 to 1 which is selected as a convenient maximum range for the conversion of typical currencies. Both large and small currency values are capable of being displayed on a single scale of the present invention without sacrificing readability of the small currency values by the novel use of the quasi-logarithmic scales of the present invention.

The method for determining the placement of the numbers on the logarithmic scales once the range of values is decided is as follows: If R and L are the numbers assigned to the right-hand ends and left-hand ends of a given lagarithimic scale (as partially seen in FIG. 1) and if P is the physical length of the logarithmic scale in inches, then the proper position on the logarithmic scale for the number N is a distance X in inches from the left-hand end measured along the scale where $$X = P \log (N) : \log (T)/L$$

The method for determining the placement of the numbers on the quasi-logarithmic scales once the cut number is decided has already been described above.

As shown most clearly in FIG. 2, the scales 2 and 22 on each side or face of the slide 1 are disposed parallel to one another and at the time laterally displaced or staggered with respect to one another so that the number aligned below a given number on one scale is the number on another scale which is obtained by multiplying the given number by an appropriate factor for calculating gratuities. In the preferred embodiment this appropriate factor is chosen to be 0.15 (i.e., fifteen percent). For example, as shown in FIG. 1, the cursor marker 8 affixed to the cursor 7 illustrates that the number 400 on the top scale is an alignment with the number 60 on the scale immediately below the top scale thereby indicating that 60 monetary units would be an appropriate priate gratuity for a charge of 400 monetary units.

Figure 3:
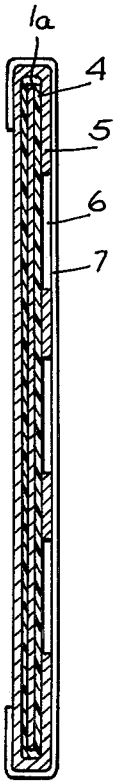
FIG. 3 illustrates a cross-sectional view along the line 3—3 of FIG. 1 showing in cross-section the assembled slide, sleeve and cursor of the currency exchange calculator.
Figure 4:
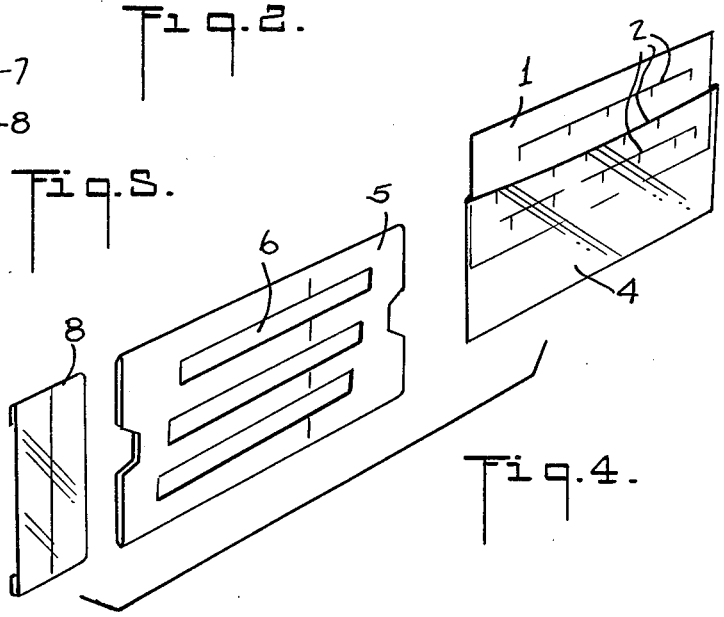
FIG. 4 illustrates an exploded perspective view of the embodiment of the currency exchange calculator of this invention shown in FIG. 1.

Referring to FIGS. 3 and 4, in the described embodiment the slide comprises a paper sheet 1*a* enclosed in a protective envelope 4 transparent, washable material such as plastic or cellophane. The slide 1 is slidable engaged within a sleeve 5 which may also be of paper and which has a plurality of rectangular transparent sections or windows 6. The windows 6 are oriented in such manner that when the slide 1 is engaged within the sleeves 5 the logarithmic scales 2 on the slide are visible at least in part through the windows 6, as shown in FIG. 1.

As shown in FIGS. 1 and 3, a transparent cursor 7 is slidably engaged about a portion of the sleeve 5. The cursor 7 includes a cursor index means 8 which may be a straight line inscribed on the cursor. In an alternate embodiment shown in FIG. 5, the cursor 7 has a groove 9 in which a cuff-link-like marker 10 is slidably engaged.

In use, the device is employed as follows. In a situation where, for example, 2,000 units of foreign currency are equivalent to 400 units of a domestic currency, one first locates a scale on which the numbers 400 and 2,000 both appear. Such a scale is the topmost scale shown in FIG. 1. Th user then sets the calculator by moving the slide 1 within the sleeve 5 until the appropriate number of the foreign currency units, i.e., 2,000, is located beneath the sleeve marking means 14 on the sleeve. Grooves 16 in the sleeve 5 facilitate the user's described movement of the slide 1. The user next moves the cursor 7 until the appropriate amount of domestic currency, i.e., 400, is seen below the cursor marking means 8 on the cursor. Once the calculator is set by moving the cursor in this manner at need not be reset so long as the only conversions desired are between these same currencies. When it is desired to convert from a known amount of foreign currency to an unknown amount of domestic currency, the slide 1 is again displaced by the user until the number representing the amount of foreign currency desired to be converted appears under the sleeve marking means 14, and the corresponding amount of domestic currency is then read as the number on the same scale which is below the cursor marking means 8.

Once the relative separation of the two marking means 8, 14 has been determined as described above, the calculator is set and the cursor 7 is no longer moved. All future operations only require motion of the slide 1 to position the amount of foreign currency desired to be converted under the marking means 14 on the sleeve 5 to enable a reading of the corresponding amount of domestic currency below the cursor marking means 8 or, alternatively, motion of the slide 1 to position the amount of domestic currency below the cursor marking means 8 to enable a reading of the corresponding amount of foreign currency under the sleeve marking means 14. In addition, the slide 1 may be removed from the sleeve 7 and turned over and reinserted into the sleeve 7. The group of scales on the reverse or opposing face 20 of the slide 1 may then be used in a similar manner for exchange rates of greater than 100 to 1 without having to adjust the relative displacement of the marking means 8, 14, if the amounts of both currencies are either less than or both greater than the cut number for the scale. If however the cut number for the quasi-logarithmic scale being used is between the amounts of the two currencies (i.e, one number is in a red portion of the scale and one is in a non-red portion) then the relative displacement of the marking means 8, 14 must be reset as described above.

Once the appropriate domestic currency is located beneath the cursor marking means 8, reference to the number appearing under this same marking means 8 on the scale immediately below provides the approprite gratuity in that domestic currency. Similarly, the appropriate gratuity in the foreign currency is located below the sleeve marking means 14 on the scale immediately below the scale having the number representing the foreign currency amount.

As is apparent from the foregoing, with the possible exception noted when one alternate the use of logarithmic and quasi-logarithmic scales, once the relative displacement of the marking means 8, 14 is determined by a single setting of the currency conversion rate between the involved countries, the cursor 7 need never be moved again until one enters a country with a different conversion factor, and when that occurs, one simply adjusts the new conversion factor with one simple operation, as described above.

Figure 5:
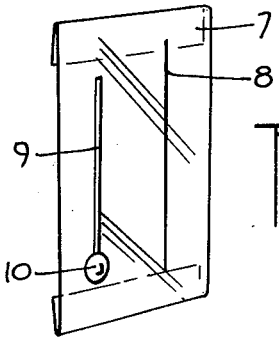
FIG. 5 illustrates a perspective view of an alternative cursor for the currency exchange calculator of this invention with a movable marker which engages with the cursor.

The marker 10 of the alternative embodiment illustrated in FIG. 5 can be employed by the user to mark the scale 2 or 22 of most frequent usefulness in the country being visited by sliding the marker 10 in the groove 9 of the cursor until the marker is aligned with said scale.

It will be appreciated that either of the two currencies may be termed "domestic" and the other "foreign" so that all of the above steps are equally well adapted for converting from smaller currency denominations to larger.

Alternatives to the embodiments described above will be obvious to those skilled in the art upon consideration of the disclosure of this invention. For example, it is apparent that the scales may be parallelly disposed in a circular fashion rather than in a straight-line fashion as shown in the drawings, and that a circular calculator may be obtained in accordance with the principles of this invention. Protection of this invention by Letters Patent is accordingly sought to the broadest extent that the prior art allows.

What is claimed is:

1. A currency exchange calculator for simultaneously displaying the monetary unis of two currencies that are related by a conversion factor comprising: (a) a slide having a plurality of parallel quasi-logarithmic scales thereon with at least one said scale being laterally displaced relative to another of said scales by a predetermined factor of displacement not related to the conversion factor, (b) a sleeve slidably engaged about at least a portion of said slide and including means for exposing at least a portion of each of said quasi-logarithmic scales and said sleeve further including a sleeve index means for indexing the position of said sleeve relative to at least one of said scales, and (c) a cursor slidably engaged about at least a portion of said sleeve and including a cursor index means for indexing the position of said cursor relative to at least one of said scales.

2. The currency exchange calculator of claim 1 wherein said predetermined factor of displacement is 15 percent.

3. The currency exchange calculator of claim 1 wherein the slide is comprised of a paper sheet fixedly contained within a protective transparent plastic envelope.

4. The currency exchange calculator of claim 1 wherein said sleeve index means is linearly disposed adjacent a plurality of said scales and said cursor index means is parallel to said sleeve index means.

5. A currency exchange calculator according to claim 1 wherein said slide comprises two faces, said first face having a plurality of parallel logarithmic scales thereon with at least one said logarithmic scale displaced relative to another of said logarithmic scales by a predetermined factor of displacement not related to the conversion factor, and said second face having thereon a plurality of said parallel quasi-logarithmic scales associated with a predetermined cut number, such that the portion of each quasi-logarithmic scale with numbers marked thereon greather than or equal to the associated cut number is different in color from the remainder of the scale, with at least one of said quasi-logarithmic scales displaced relative to another of said quasi-logarithmic scales by said predetermined factor of displacement.

6. A currency exchange calculator for displaying monetary units of two currencies related by a conversion factor as well as a predetermined percentage gratuity in each of the same two currencies, comprising:

a. a slide having
   i. one face with a first group of at least two logarithmic scales in parallel spaced-apart relationship, one of said scales being laterally displaced by the predetermined percentage with respect to another slide in said first group of slides,
   ii. an opposing face with a second group of at least two quasi-logarithmic scales, each associated with a predetermined cut number, in a parallel spaced-apart relationship which corresponds to the parallel spaced-apart relationship of said first group of scales such that the portion of each quasi-logarithmic scale with numbers marked thereon greater than or equal to the associated cut number is different in color from the remainder of the scale, and
   iii. a transparent plastic envelope extending about said two faces of said slide;
b. a sleeve slidably engaged about at least a portion of said slide and including
   i. means for exposing at least a portion of at least two of said scales, and
   ii. sleeve index means for indexing the position of said sleeve relative to at least one of said scales;
c. a transparent cursor slidably engaged about at least a portion of said sleeve and having
   i. cursor index means for indexing the position of said cursor relative to at least one of said scales, and
   ii. means for receiving a moveable marker; and
d. a marker movably engaged within said receiving means of said cursor, whereby said slide may be slidably displaced within said sleeve such that the monetary unit of one currency appearing on one of said scales is displayed through said exposing means in coincidence with said sleeve index means, and said cursor may be slidably displaced about said sleeve such that the corresponding monetary unit of the second currency appearing on the same one of said scales is displayed through said exposing means and said cursor in coincidence with said cursor index means, and said marker may be displaced within said receiving means and positioned over a portion of the same one of said scales which is exposed by said exposing means.

7. The currency calculator of claim 6 wherein the predetermined percentage is 15 percent.

* * * * *

UNITED STATES PATENT AND TRADEMARK OFFICE

CERTIFICATE OF CORRECTION

PATENT NO. : 4,028,529

DATED : June 7, 1977

INVENTOR(S) : George W. Van De Weghe

It is certified that error appears in the above-identified patent and that said Letters Patent are hereby corrected as shown below:

Column 1, line 8, change "Hertofore" to --Heretofore--.

Column 3, line 49, change "lagarithimic" to --logarithmic--.

Column 3, line 55, correct the formula to read:

-- $$X = P \log \frac{(N)}{L} \div \log \frac{(R)}{L} .$$ --

Column 3, line 62, change "at the time" to --at the same time--.

Column 4, line 6, delete "priate".

Column 4, line 41, "at" should be --it--.

Column 5, line 14, change "approprite" to --appropriate--.

Column 5, line 21, change "alternate" to --alternates--.

Column 5, line 54, change "unis" to --units--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*